US008113273B2

(12) United States Patent
Manke et al.

(10) Patent No.: US 8,113,273 B2
(45) Date of Patent: Feb. 14, 2012

(54) POWER CABLE FOR HIGH TEMPERATURE ENVIRONMENTS

(75) Inventors: Gregory H. Manke, Overland Park, KS (US); Mark Metzger, Lawrence, KS (US); Melissa Ver Meer, Shawnee, KS (US); Tricia Lespreance, Topeka, KS (US); Wayne L. Costa, Edmond, OK (US); Jason Holzmueller, Lawrence, KS (US)

(73) Assignee: Schlumberger Technology Corporation, Sugar Land, TX (US)

( * ) Notice: Subject to any disclaimer, the term of this patent is extended or adjusted under 35 U.S.C. 154(b) by 90 days.

(21) Appl. No.: 12/333,289

(22) Filed: Dec. 11, 2008

(65) Prior Publication Data

US 2010/0147505 A1 Jun. 17, 2010

(51) Int. Cl.
*H01B 7/08* (2006.01)
*E21B 43/00* (2006.01)

(52) U.S. Cl. ..... 166/66.4; 174/117 F; 174/103

(58) Field of Classification Search ..... 166/65.1, 166/66.4, 105; 174/117 F, 102 A, 103, 102 C; 417/423.3

See application file for complete search history.

(56) References Cited

U.S. PATENT DOCUMENTS

| | | | | |
|---|---|---|---|---|
| 4,284,841 | A * | 8/1981 | Tijunelis et al. | 174/103 |
| 4,665,281 | A * | 5/1987 | Kamis | 174/102 R |
| 5,426,264 | A * | 6/1995 | Livingston et al. | 174/102 R |
| 5,782,301 | A * | 7/1998 | Neuroth et al. | 166/302 |
| 6,260,615 | B1 * | 7/2001 | Dalrymple et al. | 166/60 |
| 6,910,870 | B2 | 6/2005 | Ebner | |
| 7,520,768 | B2 | 4/2009 | Nicholson | |
| 2002/0020545 | A1 * | 2/2002 | Suzuki | 174/117 F |
| 2006/0266064 | A1 | 11/2006 | Rowatt | |
| 2008/0227341 | A1 | 9/2008 | Nicholson | |

FOREIGN PATENT DOCUMENTS

| | | | |
|---|---|---|---|
| GB | 2361352 | A | 10/2001 |
| GB | 2397700 | A | 7/2004 |

* cited by examiner

*Primary Examiner* — Kenneth L Thompson
(74) *Attorney, Agent, or Firm* — Jim Patterson

(57) ABSTRACT

An electric power cable for high temperature environments includes an electric conductor; an electrical insulator disposed on the electric conductor to form an insulated conductor, the electrical insulator suited for operation in a high temperature environment; and a protective sheath disposed over the insulated conductor to form a sheathed conductor.

20 Claims, 3 Drawing Sheets

POWER CABLE FOR HIGH TEMPERATURE ENVIRONMENTS

TECHNICAL FIELD

The present application relates in general to power cables and more specifically to a high temperature power cable for downhole applications.

BACKGROUND

Power cables are utilized in various applications to transmit power, such as electricity, between distal locations. For example, power cables are utilized to transmit electrical power to electric submersible pumps (ESPs). Power cables are generally surrounded by insulation. That insulation can generally degrade under certain temperatures. ESPs and power cables that are deployed in wellbores, for example, may encounter high temperatures which degrade convention power cables resulting in the premature failure of the power cables.

SUMMARY

One embodiment of an electric power cable for high temperature environments includes an electric conductor; an electrical insulator disposed on the electric conductor to form an insulated conductor, the electrical insulator suited for operation when experiencing a high temperature for an extended period of time; and a protective sheath disposed over the insulated conductor to form a sheathed conductor.

An embodiment of a wellbore installation includes an electric submersible pump (ESP) deployed in the wellbore; and a power cable extending between the ESP and a distal electric power source, wherein the power cable includes an electric conductor; an electrical insulator disposed on the electric conductor to form an insulated conductor, the electrical insulator suited for operation when experiencing a high temperature for an extended period of time; a protective sheath disposed over the insulated conductor to form a sheathed conductor; and at least two sheathed conductors interconnected to form a cable bundle.

An embodiment of an electric submersible pump (ESP) system includes an electric power cable connected between a motor of the ESP and a distal electric power source, the power cable including an electric conductor; an electrical insulator disposed on the electric conductor to form an insulated conductor, the electrical insulator suited for operation when experiencing a high temperature for an extended period of time; a metal sheath disposed over the insulated conductor to form a sheathed conductor; and at least two sheathed conductors interconnected to form a cable bundle.

The foregoing has outlined some of the features and technical advantages in order that the detailed description that follows may be better understood. Additional features and advantages will be described hereinafter which form the subject of the claims herein.

BRIEF DESCRIPTION OF THE DRAWINGS

The foregoing and other features and aspects will be best understood with reference to the following detailed description of a specific embodiment, when read in conjunction with the accompanying drawings, wherein.

DETAILED DESCRIPTION

Figure 1:
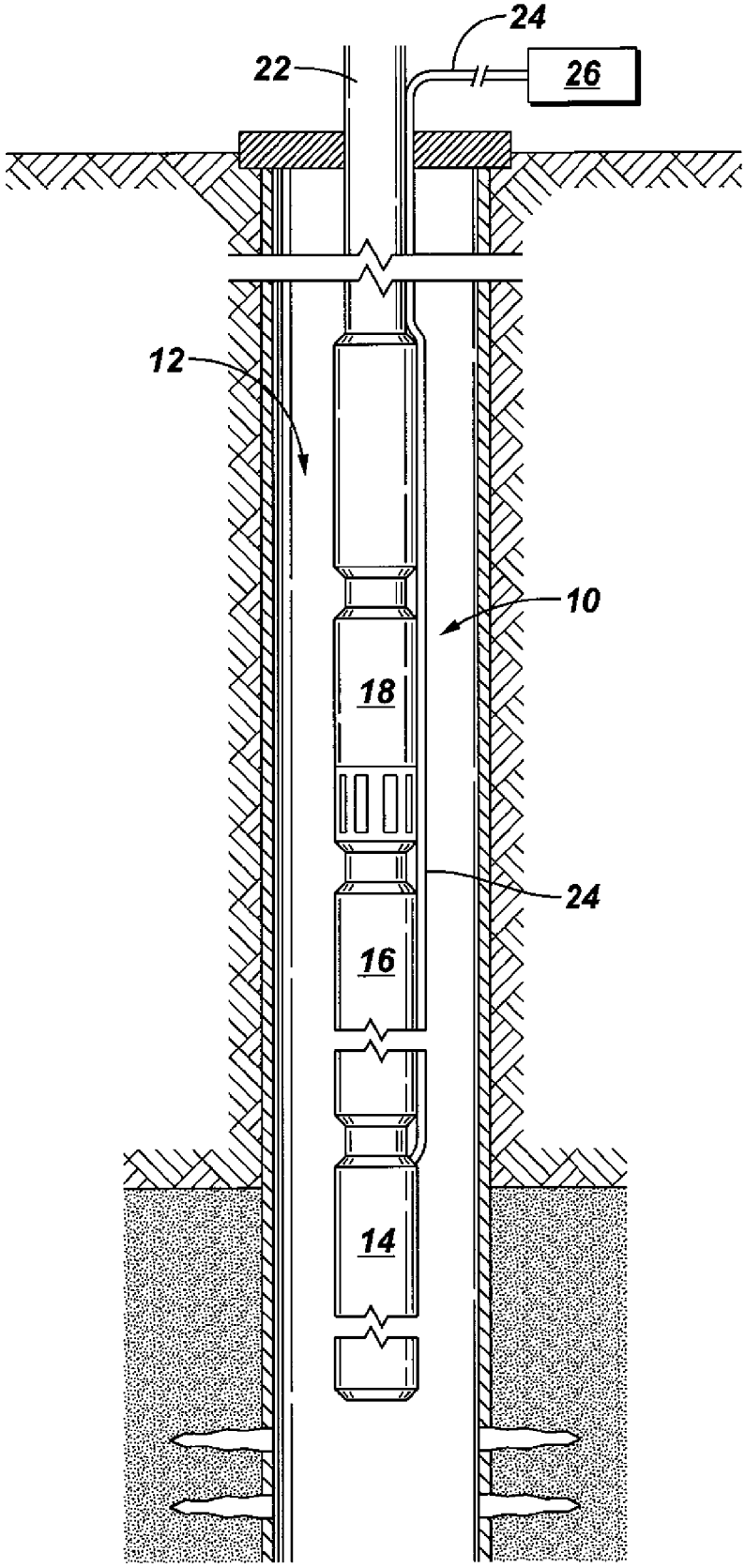
FIG. 1 is a well schematic illustrating and electric submersible pump and power cord deployed in a wellbore.

Refer now to the drawings wherein depicted elements are not necessarily shown to scale and wherein like or similar elements are designated by the same reference numeral through the several views.

FIG. 1 is a well schematic illustrating an electric submersible pump, generally denoted by the numeral 10, deployed in a wellbore 12. In the embodiment illustrated in FIG. 1, ESP 10 includes an electric motor 14, a motor protector 16 and a pump 18. Pump 18 is fluidly connected to the surface 20 via a production conduit 22. A power cable 24 is connected between an electrical power source 26 and pump 18.

Figure 2:
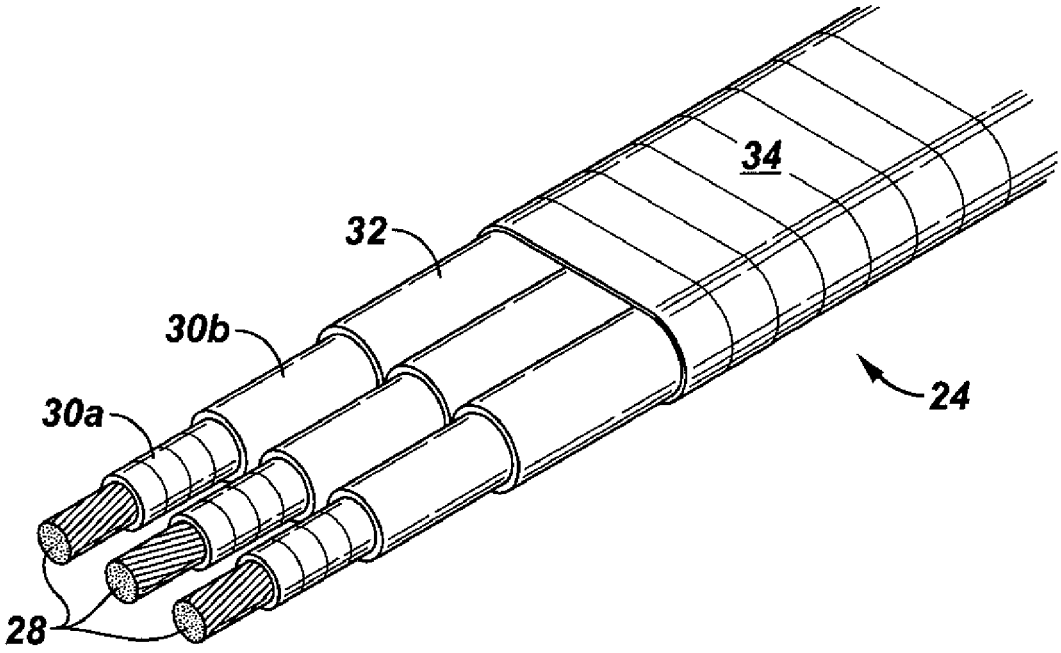
FIG. 2 is an illustration of an embodiment of a power cable.
Figure 3:
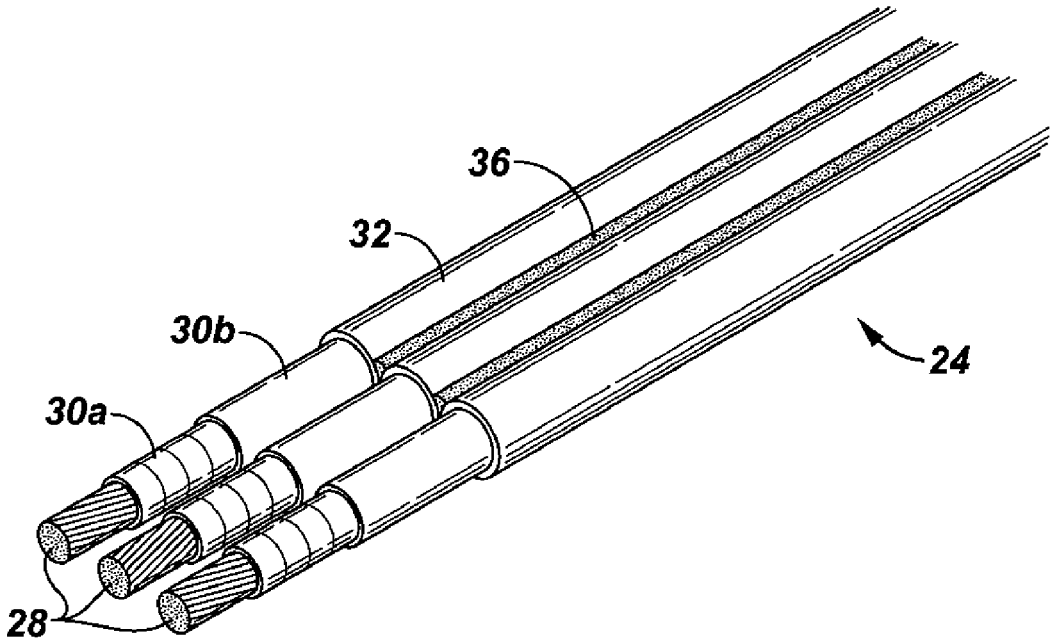
FIG. 3 is an illustration of another embodiment of a power cable.
Figure 4:
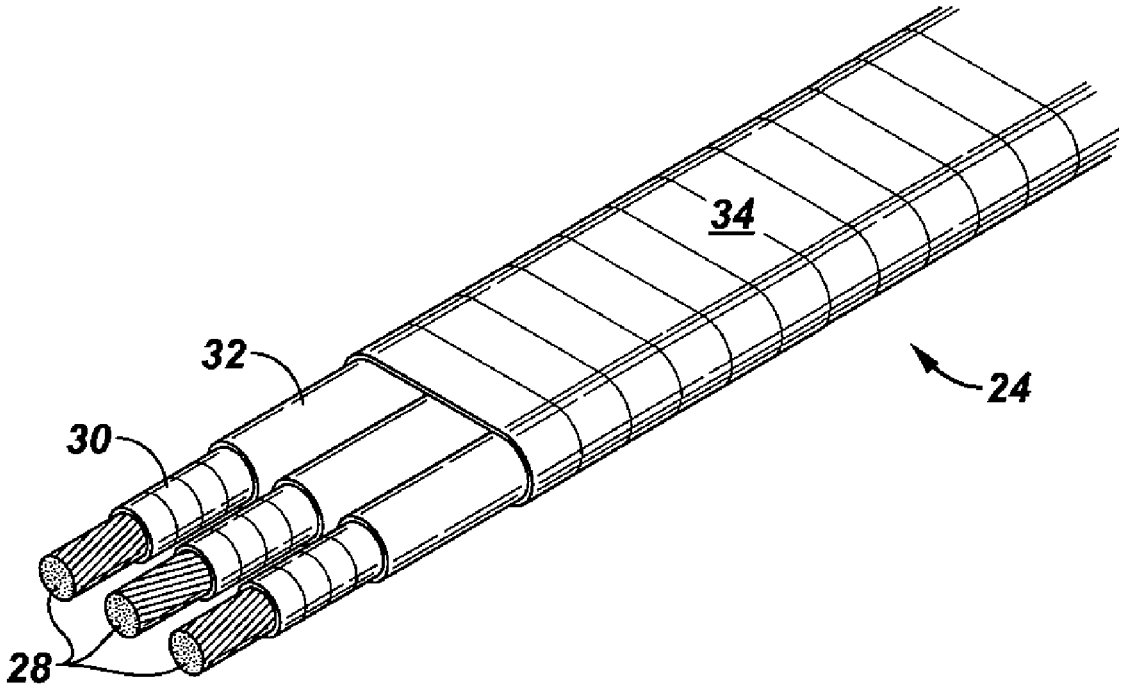
FIG. 4 is an illustration of another embodiment of a power cable.

Refer now to FIGS. 2-4 wherein embodiments of power cable 24 that are adapted for use when experiencing a high temperature for an extended period of time are illustrated. It is perceived that power cable 24 is suited for installation in environments wherein the cable temperature is continuously in a range of about 500 degrees Fahrenheit (260 degrees Celsius). It is perceived that power cable 24 can withstand temperatures in excess of 500 degrees F. for extended lengths of times without significant degradation that renders the cable inoperable, as is needed for installations such as a wellbore deployed ESP.

The Power cable 24 may include one or more electrical conductors. In the illustrated embodiments, power cable 24 includes three electrical conductors 28. Each conductor 28 can be surrounded with an electrical insulation 30 and a protective sheath 32. The two or more of the insulated and sheath conductors are then interconnected to form cable bundle.

Refer now specifically to FIG. 2 wherein an embodiment of power cable 24 is illustrated. Power cable 24 is illustrated as having three electrical conductors 28 formed of copper. In this embodiment, insulator 30 includes at least two layers (30*a*, 30*b*) of insulating material. The insulating layers may be formed of the same or different material. In one example, one insulating layer may be a high temperature dielectric tape and the other layer may be dielectric tape or extruded material.

In the embodiment of FIG. 2, the two layers are formed of different material each of which is suited for continuous operation while experiencing a temperature of 500 degrees F. and greater. In this example, first insulating layer 30*a* is a dielectric material such as and without limitation polyimide. Polyimide layer 30*a* is a tape helically wrapped about conductor 28. Second insulating layer 30*b* may be a dielectric material such as without limitation a fluoropolymer tape or an extruded fluoropolymer layer. In one embodiment the fluoropolymer is selected from a group including polytetrafluoroethylene or polytetrafluoroethene (PTFE), fluorinated ethylene propylene (FEP), or perfluoroalkoxy (PFA). If more than one layer of tape is utilized, the layer may be helically wrapped in the same direction or in opposite directions. The material may include an adhesive on one or both sides for bonding to the conductor, itself, other layers of insulating material and the like.

Protective sheath 32 is disposed over the insulated conductor 28. Sheath 32 is constructed of a material suited for protecting the insulated conductor 28 in the environment in which it is deployed. For example, sheath 32 in the illustrated embodiments is constructed of a material that can provide physical protection to conductor 28 in a wellbore environment and in a high temperature environment. In some embodiments, sheath 32 is constructed of a metallic material such as without limitation stainless steel, MONEL, carbon steel, lead or the like.

The insulated and sheathed conductors 28 are interconnected to form a power cable 24 suited for the particular service. In the embodiment of FIG. 2, insulated and sheathed conductors 28 are interconnected by wrapping with an outer layer of material 34. Outer layer 34, referred to from time to time as armor layer 34, may be constructed of a metallic or non-metallic material. In FIG. 2, conductors 28 are shown positioned and interconnected to form a planar power cable 24. However, it should readily be recognized that conductors 28 may be positioned relative to each other in a variety of manners. For example, interconnected conductors 28 may form a triangular or cylindrically shaped power cable 24.

Refer now to FIG. 3, wherein another embodiment of a power cable 24 is illustrated. This embodiment is substantially similar in construction as that described with reference to FIG. 2. One difference between this described embodiment and the prior described embodiment is that the insulated and sheathed conductors 28 are bonded together and do not include an outer layer interconnecting conductors 28. For example, and without limitation, insulated and sheathed conductors 28 may be interconnected by welding or an adhesive material illustrated generally by the numeral 36. For example, in this embodiment sheaths 32 are metallic and sheaths 32 are interconnected by bonding at bead 36.

Referring now to FIG. 4, another embodiment of power cable 24 is illustrated. In this embodiment it is clearly shown that each conductor 28 is insulated with a single layer of insulating material 30. Sheath 32 is then disposed over insulating layer 30 and conductor 28 as further described with reference to FIGS. 2 and 3. Sheathed conductors 28 may then be interconnected to form power cable 24.

From the foregoing detailed description of specific embodiments, it should be apparent that a system for a high temperature power cable that is novel has been disclosed. Although specific embodiments have been disclosed herein in some detail, this has been done solely for the purposes of describing various features and aspects and is not intended to be limiting with respect to the scope of the claims herein. It is contemplated that various substitutions, alterations, and/or modifications, including but not limited to those implementation variations which may have been suggested herein, may be made to the disclosed embodiments without departing from the spirit and scope of the appended claims which follow.

What is claimed is:

1. An electrical power cable for high temperature environments, the power cable comprising:

two or more sheathed conductors, each sheathed conductor comprising an electrical conductor, an electrical insulator surrounding the electrical conductor, and a metallic sheath surrounding the electrical insulator; and a weld bead interconnecting the metallic sheaths of the two or more sheathed conductors positioned adjacent to one another to form a planar cable.

2. The power cable of claim 1, wherein the planar cable does not comprise an outer layer interconnecting the plurality of sheathed conductors.

3. The power cable of claim 1, wherein the electrical insulator is formed of one of a polyimide or a fluoropolymer.

4. The power cable of claim 1, wherein the electrical insulator is formed of a fluoropolymer selected from the group consisting of polytetrafluoroethylene, polytetrafluoroethene, fluorinated ethylene propylene, and perfluoroalkoxy.

5. The power cable of claim 1, wherein the electrical insulator comprises at least two layers of dielectric material.

6. The power cable of claim 5, wherein the at least two layers of dielectric material are formed of different dielectric materials.

7. The power cable of claim 1, wherein the electrical insulator comprises an insulator layer formed of a polyimide material and an insulator layer formed of a fluoropolymer material.

8. The power cable of claim 1, wherein the electrical insulator is constructed of a material that provides electric insulation when deployed in a temperature of at least 500 degrees Fahrenheit.

9. A wellbore installation comprising:

an electric submersible pump (ESP) deployed in the wellbore; and a power cable extending between the ESP and a distal electric power source, the power cable comprising:

two or more sheathed conductors, each sheathed conductor comprising an electrical conductor, an electrical insulator surrounding the electrical conductor, and a metallic sheath surrounding the electrical insulator; and a weld bead interconnecting the metallic sheaths of the two or more sheathed conductors positioned adjacent to one another to form a planar cable.

10. The wellbore installation of claim 9, wherein the electrical insulator is formed of one of a polyimide or a fluoropolymer.

11. The wellbore installation of claim 9, wherein the electrical insulator comprises at least two layers of dielectric material.

12. The wellbore installation of claim 11, wherein the at least two layers of dielectric material are formed of different dielectric materials.

13. The wellbore installation of claim 9, wherein the electrical insulator comprises an insulator layer formed of a polyimide material and an insulator layer formed of a fluoropolymer material.

14. The wellbore installation of claim 9, wherein the high temperature is at least 500 degrees Fahrenheit.

15. The power cable of claim 9, wherein the planar cable does not comprise an outer layer interconnecting the plurality of sheathed conductors.

16. An electric submersible pump (ESP) system, the system comprising:

a pump;

an electric motor connected to the pump; and an electrical power cable connected between the motor and a distal electric power source, the power cable comprising:

two or more sheathed conductors, each sheathed conductor comprising an electrical conductor, an electrical insulator surrounding the electrical conductor, and a metallic sheath surrounding the electrical insulator; and a weld bead interconnecting the metallic sheaths of the two or more sheathed conductors positioned adjacent to one another to form a planar cable.

17. The system of claim 16, wherein the electrical insulator comprises at least two layers of dielectric material.

18. The system of claim 17, wherein the at least two layers of dielectric material are formed of different dielectric materials.

19. The system of claim 16, wherein the high temperature is at least 500 degrees Fahrenheit.

20. The power cable of claim 16, wherein the planar cable does not comprise an outer layer interconnecting the plurality of sheathed conductors.

* * * * *